US010741323B2

(12) United States Patent
Aoki et al.

(10) Patent No.: US 10,741,323 B2
(45) **Date of Patent: *Aug. 11, 2020**

(54) COIL COMPONENT AND ELECTRONIC DEVICE EQUIPPED WITH THE SAME

(71) Applicant: Taiyo Yuden Co., Ltd., Chuo-ku, Tokyo (JP)

(72) Inventors: Hidenori Aoki, Takasaki (JP); Masashi Kuwahara, Takasaki (JP); Hideki Ogawa, Takasaki (JP)

(73) Assignee: TAIYO YUDEN CO., LTD, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/356,771

(22) Filed: Mar. 18, 2019

(65) Prior Publication Data

US 2019/0259528 A1 Aug. 22, 2019

Related U.S. Application Data

(63) Continuation of application No. 14/811,495, filed on Jul. 28, 2015, now Pat. No. 10,276,296.

(30) Foreign Application Priority Data

Aug. 1, 2014 (JP) ..... 2014-158225

(51) Int. Cl.
*H01F 27/29* (2006.01)
*H01F 27/32* (2006.01)
*H01F 17/04* (2006.01)

(52) U.S. Cl.
CPC ..... *H01F 27/292* (2013.01); *H01F 17/045* (2013.01)

(58) Field of Classification Search
CPC ..... H01F 27/29; H01F 27/327; H01F 5/06; H01F 17/045; H01F 27/292
See application file for complete search history.

(56) References Cited

U.S. PATENT DOCUMENTS 3,493,909 A * 2/1970 Beverly ..... H01F 17/045 336/178
4,777,461 A * 10/1988 Sakamoto ..... H03H 1/00 333/184

(Continued)

FOREIGN PATENT DOCUMENTS

| | | | |
|---|---|---|---|
| CN | 103177850 | A | 6/2013 |
| JP | 2008166596 | A | 7/2008 |
| JP | 2011165696 | A | 8/2011 |

OTHER PUBLICATIONS

A Second Office Action issued by the State Intellectual Property Office of China dated Jun. 1, 2017 for Chinese counterpart application No. 201510463002.9.

(Continued)

*Primary Examiner* — Elvin G Enad
*Assistant Examiner* — Malcolm Barnes
(74) *Attorney, Agent, or Firm* — Law Office of Katsuhiro Arai

(57) ABSTRACT

A coil component includes: a pillar part; first and second rectangular planar parts, each having long sides L, short sides S, and thickness T; a coil formed around the pillar part; two terminal electrodes electrically connected to both ends of the coil; and an outer sheath containing magnetic grains and resin material and covering the coil at least partially; wherein the thickness $P_L$ in the L direction and thickness $P_S$ in the S direction, of the outer sheath, in a section cut across the center of the pillar part and in parallel with the LS planes, satisfy the relationship of $P_L<P_S$.

20 Claims, 2 Drawing Sheets

(56) References Cited

U.S. PATENT DOCUMENTS 5,680,087 A * 10/1997 Sakata ..... H01F 27/292 336/192
5,963,119 A * 10/1999 Takeda ..... H01F 17/0033 336/206
6,144,280 A * 11/2000 Amada ..... H01F 17/045 29/602.1
6,392,523 B1 * 5/2002 Tsunemi ..... H01F 17/045 336/192
7,209,022 B2 * 4/2007 Kuroiwa ..... H01F 17/045 336/200
7,477,122 B2 * 1/2009 Iguchi ..... H01F 17/045 336/192
7,656,260 B2 * 2/2010 Suzuki ..... H01F 17/045 29/602.1
7,786,838 B2 * 8/2010 Nakada ..... H01F 1/344 29/602.1
8,212,641 B2 7/2012 Wu et al.
8,438,720 B2 5/2013 Muneuchi et al.
9,147,514 B2 9/2015 Nakada et al.
10,276,296 B2 * 4/2019 Aoki ..... H01F 17/045
2001/0038327 A1 * 11/2001 Aoki ..... H01F 17/045 336/83
2006/0071749 A1 * 4/2006 Aoki ..... H01F 17/045 336/83
2007/0146110 A1 * 6/2007 Oki ..... H01F 17/045 336/232
2008/0309443 A1 * 12/2008 Furuya ..... H01F 17/045 336/83
2010/0182115 A1 7/2010 Huang et al.
2010/0219924 A1 * 9/2010 Wu ..... H01F 17/045 336/83
2011/0267167 A1 11/2011 Ogawa et al.
2012/0038449 A1 2/2012 Ogawa et al.
2012/0086534 A1 * 4/2012 Wu ..... H01F 17/045 336/83
2013/0186995 A1 * 7/2013 Yamaguchi ..... H01F 5/02 242/432.6
2013/0328653 A1 12/2013 Wu et al.
2014/0070914 A1 * 3/2014 Oki ..... H01F 27/29 336/192
2015/0002252 A1 * 1/2015 Masaki ..... H01F 27/2876 336/192
2015/0235758 A1 * 8/2015 Takagi ..... H01F 27/2828 336/192
2016/0027574 A1 * 1/2016 Aoki ..... H01F 27/292 336/192
2016/0035482 A1 2/2016 Aoki et al.

OTHER PUBLICATIONS

Final Office Action issued by U.S. Patent and Trademark Office, dated May 30, 2017, for related U.S. Appl. No. 14/811,495.
Non-Final Office Action issued by U.S. Patent and Trademark Office, dated Jan. 9, 2018, for related U.S. Appl. No. 14/811,495.
Non-Final Office Action issued by U.S. Patent and Trademark Office, dated May 18, 2016, for related U.S. Appl. No. 14/811,495.
Non-Final Office Action issued by U.S. Patent and Trademark Office, dated Nov. 18, 2016, for related U.S. Appl. No. 14/811,495.
Notice of Allowance issued by U.S. Patent and Trademark Office, dated Dec. 17, 2018, for related U.S. Appl. No. 14/811,495.

* cited by examiner

COIL COMPONENT AND ELECTRONIC DEVICE EQUIPPED WITH THE SAME

CROSS-REFERENCE TO RELATED APPLICATIONS

This application is a continuation of U.S. patent application Ser. No. 14/811,495, filed Jul. 28, 2015, which claims priority to Japanese Patent Application No. 2014-158225, filed Aug. 1, 2014, each disclosure of which is incorporated herein by reference in its entirety. The applicant herein explicitly rescinds and retracts any prior disclaimers or disavowals made in any parent, child or related prosecution history with regard to any subject matter supported by the present application.

BACKGROUND

Field of the Invention

The present invention relates to a coil component having a so-called drum core, as well as an electronic device equipped with such coil component.

Description of the Related Art

There is a type of coil component referred to as the drum coil component, which has a drum core made of magnetic material, etc., and a coil formed by winding an insulating sheath conductor around the core. Mobile devices and other electronic devices of higher performance are required, which gives rise to a need for supplying high-performance components. Coil components are increasingly used in applications requiring high saturated current. Also, as electronic devices become increasingly smaller, there is a strong demand for smaller coil components.

Patent Literature 1 discloses an invention relating to a drum core characterized by easy winding and ease of suppressing the characteristic variation caused by winding. In addition, as a way to more effectively utilize space, a method is proposed whereby molding resin (containing ferrite) is provided on the outside of the winding. Formation of molding resin improves the shielding property and allows the inductance to be raised. In other words, increasing the amount of molding resin and thereby raising the shielding property is effective in raising the inductance.

Any discussion of problems and solutions involved in the related art has been included in this disclosure solely for the purposes of providing a context for the present invention, and should not be taken as an admission that any or all of the discussion were known at the time the invention was made.

BACKGROUND ART LITERATURES

[Patent Literature 1] Japanese Patent Laid-open No. 2011-165696

SUMMARY

However, the art described in Patent Literature 1 above causes the external electrodes to become dirty, especially when the coil component is small with a height of 1 mm or less, which limits how much the amount of molding resin can be increased.

In light of the above, an object of the present invention is to provide a coil component equipped with an outer sheath material that supports small component size, prevents the terminal electrodes from becoming dirty and exhibits high shielding property, as well as an electronic device equipped with such coil component.

After studying in earnest, the inventors of the present invention completed the present invention described below:

(1) A coil component comprising: a pillar part; first and second rectangular planar parts, each having rectangular principle faces with long sides and short sides as well as side faces extending in the thickness direction; a coil formed by winding an insulating sheath conductor around the pillar part; two terminal electrodes electrically connected to both ends of the coil; and an outer sheath containing magnetic grains and resin material and covering the coil at least partially; wherein both ends of the pillar part are connected to the principle faces of the first and second rectangular planar parts, respectively; the pillar part and first and second rectangular planar parts are each made of a magnetic body; the two terminal electrodes are respectively formed along the two planes specified by the short sides of the outer principle face and side faces extending in the thickness direction, of the first rectangular planar part; and the thickness $P_L$ in the long-side direction and thickness $P_S$ in the short-side direction, of the outer sheath, in a section cut across the center of the pillar part and in parallel with the principle faces, meet the relationship of $P_L<P_S$.

(2) A coil component according to (1), wherein the magnetic grains contained in the outer sheath are metal magnetic grains.

(3) A coil component according to (1) or (2), wherein the cross-section area of the pillar part in a section cut across the center of the pillar part and in parallel with the principle faces, is greater than the cross-section area of the outer sheath.

(4) A coil component according to any one of (1) to (3), wherein both ends of the coil are each led out to one plane specified by a long side and side face extending in the thickness direction, of the first rectangular planar part, and the led-out parts are covered with the outer sheath.

(5) A coil component according to any one of (1) to (3), wherein both ends of the coil are each joined to one plane specified by a long side and side face extending in the thickness direction, of the first rectangular planar part, and the joined parts are covered with the outer sheath.

(6) An electronic device equipped with a coil component according to any one of (1) to (5).

According to the present invention, a coil component is provided that prevents the terminal electrodes, etc., from getting dirty and exhibits high inductance despite its small size. To be specific, forming an outer sheath thicker along the long sides of the magnetic body (pillar part) ensures sufficient shielding property and eliminates any effect the outer sheath along the short sides might have on the dimensions of the short sides. As a result, sufficient shielding property can be ensured simply by forming an outer sheath along the long sides, even when the outer sheath material having a high magnetic grain fill ratio and consequently unfavorable wet spreading property is used, and by reducing the amount of outer sheath material along the short sides, a level of uncleanness of the terminal electrodes that would affect the mounting can be eliminated.

According to a favorable embodiment, the saturated current can be raised further because metal magnetic grains are contained in the outer sheath. According to another favorable embodiment, an outer sheath material densely filled with magnetic grains can be used, and high inductance can be achieved even when the cross-section area of the outer sheath is decreased. Furthermore, the cross-section area of the magnetic body can be increased by a portion corresponding to the decrease in the cross-section area of the outer sheath, and consequently the saturated current can be raised. According to yet another favorable embodiment, placing the lead-outs of coil ends along the long sides of the rectangular planar part eliminates any effect on mounting, while the partial presence of the outer sheath on the side faces of the rectangular planar part protects the led-out conductive wires. According to yet another favorable embodiment, placing the joining parts along the long sides of the rectangular planar part eliminates any effect on mounting, while the partial presence of the outer sheath on the side faces of the rectangular planar part protects the joined conductive wires and solves the problem of the core and outer sheath separating, even in a high-temperature environment. An electronic device equipped with a coil component according to the present invention is expected to permit further size reduction and performance improvement.

For purposes of summarizing aspects of the invention and the advantages achieved over the related art, certain objects and advantages of the invention are described in this disclosure. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description which follows.

BRIEF DESCRIPTION OF THE DRAWINGS

These and other features of this invention will now be described with reference to the drawings of preferred embodiments which are intended to illustrate and not to limit the invention. The drawings are greatly simplified for illustrative purposes and are not necessarily to scale.

FIG. 1(A) is a plan view, FIG. 1(C) is a view showing section A-A' in (B).

FIG. 2(A) is a plan view of the core; FIG. 2(B) is a side view of the core; FIG. 2(C) is a plan view of the core, coil and terminal electrodes; and FIG. 2(D) is a side view of the same.

DESCRIPTION OF THE SYMBOLS

Figure 1:
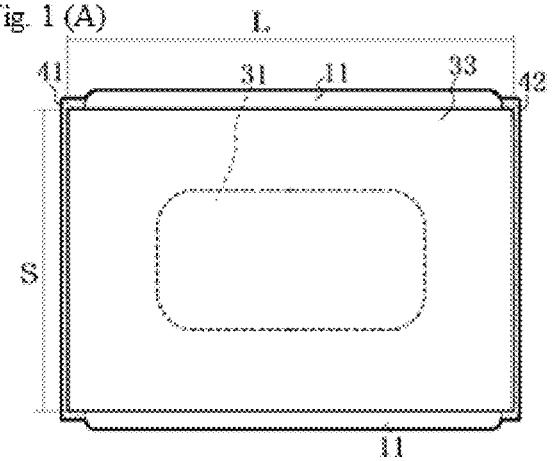
FIG. 1 shows schematic diagrams of a coil component according to the present invention.
Figure 1:
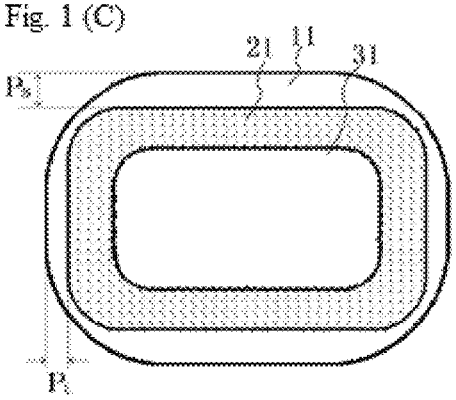

11: Outer sheath; 21: Coil; 22, 23: Coil end; 31: Pillar part; 32, 33: Rectangular planar part; 41, 42: Terminal electrode

DETAILED DESCRIPTION OF EMBODIMENTS

The present invention is described in detail below by referring to the drawings as deemed appropriate. It should be noted, however, that the present invention is not limited to the embodiment illustrated, and because characteristic parts of the invention may be emphasized in the drawings, the scale of each part of the drawings is not necessarily accurate.

The coil component of the present invention is a coil component comprising a core and a coil wound around the pillar part of the core.

Figure 1B:
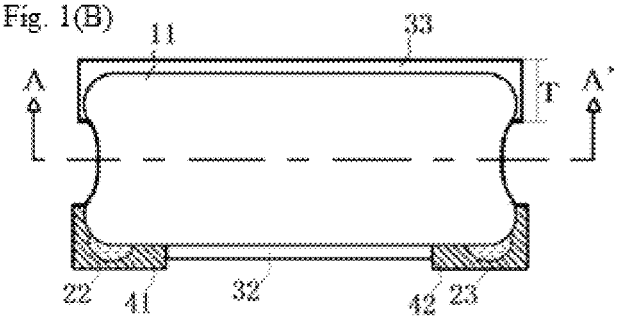
FIG. 1(B) is a side view.
Figure 2:
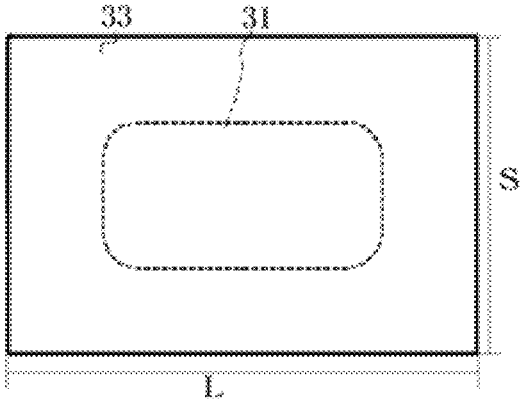
FIG. 2 shows schematic diagrams of a partial structure of a coil component according to the present invention where
Figure 2:
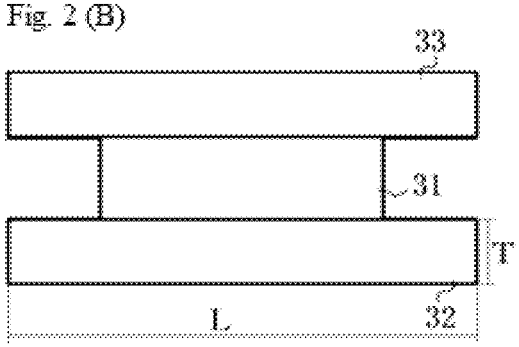
Figure 2:
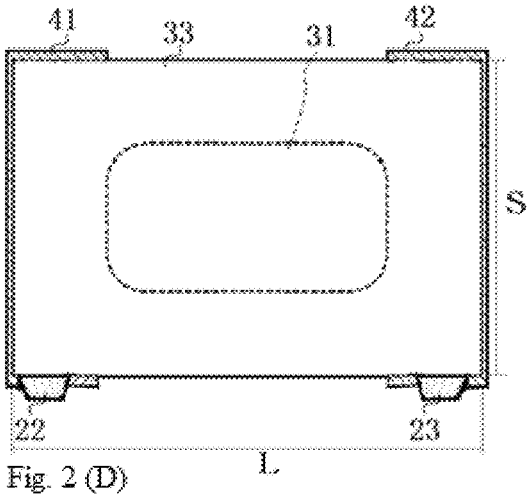
Figure 2:
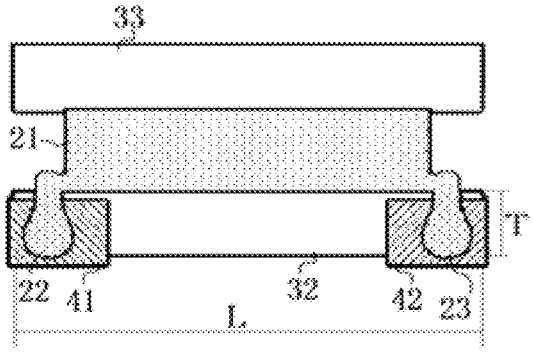

FIG. 1 provides schematic diagrams of an example of a coil component according to the present invention. FIG. 1(A) is a plan view, FIG. 1(B) is a side view, and FIG. 1(C) is a view showing section A-A' in (B). The core has a pillar part 31, first rectangular planar part 32, and second rectangular planar part 33. FIG. 2 provides schematic diagrams of a partial structure of one example of a coil component according to the present invention. FIG. 2(A) is a plan view of the core, while FIG. 2(B) is a side view of the core. FIG. 2(C) is a plan view of the core, coil and terminal electrodes, while FIG. 2(D) is a side view of the same.

The shape of the pillar part 31 is not limited in any way so long as there is an area where an insulating sheath conductor can be wound around it, but a solid shape having a long axis in one direction, such as a cylinder or prism, is preferred. The first and second rectangular planar parts 32, 33 are provided on both ends of the long axis, respectively, and each have rectangular principle faces with long sides L and short sides S as well as a specified thickness T. Preferably the both ends of the long axis of the pillar part 31 contact the centers of the rectangular principle faces of the first and second rectangular planar parts 32, 33. Here, the pillar part 31 and first and second rectangular planar parts 32, 33 may be constituted integrally. Preferably the principle faces of the first and second rectangular planar parts 32, 33 are placed in parallel with one another. Also, preferably the long axis of the pillar part 31 is vertical to the principle faces of the first and second rectangular planar parts 32, 33. Under the present invention, terminal electrodes 41, 42 are formed on one rectangular planar part, and the rectangular planar part on which the terminal electrodes 41, 42 are thus formed is defined as the first rectangular planar part 32. The terminal electrodes 41, 42 are electrically connected to coil ends 22, 23 described later, and normally the coil component of the present invention can be electrically connected to a board, etc., via the terminal electrodes 41, 42.

In the following explanations, the pillar part 31 and first and second rectangular planar parts 32, 33 may be collectively referred to as the core, while the principle faces of the first and second rectangular planar parts 32, 33, or specifically the faces specified by the long sides L and short sides S, may also be referred to as "LS faces," and the faces specified by the thickness T and long sides L may also be referred to as "LT planes." Preferably the rectangular planar parts 32, 33 have the same size and thickness dimensions. Also, the rectangular planar parts need not be completely flat on all sides and can have chamfered corners and/or lead-out grooves.

The pillar part 31 and first and second rectangular planar parts 32, 33 are made of a magnetic body. The type of magnetic body is not limited in any way, and ferrite material, metal magnetic grains, etc., can be used. Ferrite material is a material constituted in such a way that a complex oxide with iron oxide and other metal oxides exhibits magnetic property, and any known ferrite material can be used without limitation. For example, Ni—Zn ferrite or Mn—Zn ferrite with a magnetic permeability of approx. 200 to 2000 can be used favorably, or the like. Such ferrite material is mixed with binder and metal dies are used to apply pressure to the mixture to form it into a drum shape, after which the drum is sintered or otherwise processed to obtain the pillar part 31 and first and second rectangular planar parts 32, 33. The ferrite material may be glass-coated or given other powder treatment. For the specific method to form a core from ferrite material, any known art can be referenced as deemed appropriate.

Metal magnetic grain is a material constituted in such a way that its non-oxidized metal parts exhibit magnetic property. Examples include non-oxidized metal grains and alloy grains, as well as grains formed by providing oxide, etc., around the foregoing grains, or the like. Metal magnetic grains may be grains manufactured by the atomization method, for example. To be specific, any known alloy grain manufacturing method may be adopted, or any commercial product such as PF-20F manufactured by Epson Atmix Corporation or SFR—FeSiAl manufactured by Nippon Atomized Metal Powders Corporation may be used. Examples of metal magnetic grains include alloy materials such as Fe—Si—Cr, Fe—Si—Al, and Fe—Ni, non-crystalline materials such as Fe—Si—Cr—B—C and Fe—Si—B—Cr, Fe, and mixtures of the foregoing, where powder compacts obtained from these grains are used favorably, but such powder compacts that have been heat-treated to form oxide film are more favorable because they exhibit high saturated current.

An insulating sheath conductor is wound around the pillar part 31 of the core to obtain a coil 21. For the embodiment of the insulating sheath conductor, as well as the form, method, and other details of winding the insulating sheath conductor around the pillar part 31, any conventional art can be referenced as deemed appropriate. Preferably the insulating sheath conductor is wound around the pillar part 31 according to a winding. Also, preferably a rectangular wire is used as the insulating sheath conductor, because it reduces the height gaps on the coil 21 surface and allows a thin outer sheath 11 to be formed in a stable manner.

As shown in FIGS. 2(C) and (D), the terminal electrodes 41, 42 are formed on the first rectangular planar part 32. Here, the terminal electrodes 41, 42 are formed, respectively, at least along the two ST planes that are planes specified by the short sides and side faces extending in the thickness direction, of the first rectangular planar part 32. The first rectangular planar part 32 has two ST planes on the left side and right side of the drawings in FIGS. 2(C) and 2(D), and has two LT planes on the front side and rear side of the drawings. In the embodiment illustrated, the one terminal electrode 41 is formed on the outer principle face of the rectangular planar part 32 and continues to the ST plane on the left side of the drawing, and then bends and extends to a part of the LT plane (near the left edge). The other terminal electrode 42 is formed on the outer principle face of the rectangular planar part 32 and continues to the ST plane on the right side of the drawing, and then bends and extends to a part of the LT plane (near the right edge). Preferably the terminal electrodes 41, 42 extend from the outer principle face of the rectangular planar part 32 to at least one half the thickness T. Both ends of the coil 21 are each led out from one plane, or LT plane, specified by a long side and side face extending in the thickness direction, of the rectangular planar part 32, and electrically connected to the terminal electrodes 41, 42, respectively. The terminal electrodes and both ends of the coil are connected on the outer principle face, or side face along the long side, of the rectangular planar part 32. In FIGS. 2(C) and 2(D), the connections are shown to take place on one plane, or LT plane, specified by a long side and side face extending in the thickness direction, of the rectangular planar part 32, and the height dimension can be reduced by making the connections on the LT plane. The terminal electrodes 41, 42 are electrically connected to both ends 22, 23 of the coil 21, respectively, and can be used as points of external contact for the coil component of the present invention.

In the Specification, the "outer principle face" refers to, of the two principle faces the first rectangular part 32 has, the one principle face not contacted by the pillar part 31.

Forming the terminal electrodes "along the ST planes" means that the terminal electrodes are formed "near the ST planes" and may or may not extend to the ST planes. To be specific, it means that, when the "LS plane" is equally divided into an "area along the one ST plane," "area along the other ST plane" and "area sandwiched between the two ST planes," the terminal electrodes are contained in the "area along the one ST plane" and "area along the other ST plane."

Accordingly, "terminal electrodes are respectively formed along the two planes specified by the short sides of the outer principle face and side faces extending in the thickness direction, of the first rectangular planar part" implies the following:

1) The terminal electrodes 41, 42 are formed on, of the principle faces of the first rectangular planar part 32, the principle face not contacted by the pillar part 31.

2) The terminal electrode denoted by 41 is formed "near the one ST plane" of the aforementioned principle face.

3) The terminal electrode denoted by 42 is formed "near the other ST plane" of the aforementioned principle face.

4) The terminal electrodes 41, 42 may or may not extend to the ST planes.

The form and manufacturing method of the terminal electrodes 41, 42 are not limited in any way, but preferably they are formed by plating, and more preferably they contain Ag, Ni, and Sn. For example, an Ag paste is applied onto the first rectangular planar part 32 and baked to form a base, after which the base is Ni- and Sn-plated and a solder paste is applied on top, and then the solder is fused to embed the ends of the coil, thus electrically joining the winding and the terminal electrodes.

The coil 21 is covered with the outer sheath 11 at least partially. The outer sheath 11 contains resin material and magnetic grains. Presence of the outer sheath 11 increases the shielding property of the magnetic flux. Preferably the magnetic grains account for 75 to 88 percent by volume of the weight of the outer sheath 11, and by increasing the content ratio of the magnetic grains this way, high inductance is expected and, because of the resulting low fluidity, post-application wet spreading is suppressed and the accuracy of application improves.

The type of the magnetic grains contained in the outer sheath 11 is not limited in any way and the grains may be formed by the aforementioned ferrite, but the aforementioned metal magnetic grains are preferred because they achieve high saturated current.

The outer sheath 11 can be formed by, for example, kneading and mixing magnetic grains and resin material and then coating the mixture on the outside of the coil 21. As for the application method, a dispenser may be used, or preferably the roller transfer method is used, and the outer sheath 11 can be obtained by means of thermosetting, or the outer sheath 11 can be formed partially by placing a semi-finished outer sheath 11 before forming in resin-filled dies and curing it, or by means of dipping, etc. The resin material for outer sheath 11 is not limited in any way, and examples include, but are not limited to, epoxy resin, phenol resin, and polyester resin.

The outer sheath 11 may be formed as described above after applying resin material free from magnetic grains to the coil 21. This further reduces the height gaps of the coil 21 and consequently a thinner outer sheath 11 can be formed. Besides the foregoing, the method to obtain an outer sheath 11 from magnetic grains and resin material is not limited in any way, and any known means in the field of coating technology or coating film forming technology can be incorporated as deemed appropriate.

Under the present invention, the formed thicknesses of the outer sheath 11 are important.

Here, the focus is on a section cut across the center of the pillar part 31 and in parallel with the principle faces of the first and second rectangular planar parts 32, 33. This section is illustrated schematically in FIG. 1(C). In this section, the thickness of the outer sheath 11 in the long-side L direction of the first and second rectangular planar parts 32, 33 is defined as $P_L$, while the thickness of the outer sheath 11 in the short-side S direction of the first and second rectangular planar parts 32, 33 is defined as $P_S$. In the aforementioned section, $P_L$ and $P_S$ indicate the maximum formed thicknesses of the outer sheath 11 as measured in the long-side L direction and short-side S direction, respectively, from the coil 21. Under the present invention, $P_L<P_S$ holds. In other words, the outer sheath 11 is formed thickly along the long side L and thinly along the short side S. Preferably $P_L$ is 0 to 150 mm, while $P_S$ is 300 to 350 mm, thus providing a thickness difference of twice or more.

Preferably the cross-section area of the pillar part 31 is greater than the cross-section area of the outer sheath 11. By setting the cross-section area of the pillar part 31 constituted by a magnetic body greater than that of the outer sheath 11, high saturated current can be achieved.

Preferably the both ends of the coil 21 are led out from one plane, or LT plane, specified by a long side and side face extending in the thickness direction, of the first rectangular planar part 32, and the led-out parts are covered with the outer sheath 11. Presence of the outer sheath partially on the side face of the rectangular planar part protects the led-out conductive wires.

Also, preferably the both ends of the coil 21 are joined to one plane, or LT plane, specified by a long side and side face extending in the thickness direction, of the first rectangular planar part 32, and the joined parts are covered with the outer sheath 11. Presence of the outer sheath 11 partially on the side face of the first rectangular planar part 32 protects the joined conductive wires and solves the problem of the core and outer sheath 11 separating, even in a high-temperature environment.

The coil component of the present invention can be installed in various electronic devices and these electronic devices also represent embodiments of the present invention.

EXAMPLES

The present invention is explained more specifically below using examples. It should be noted, however, that the present invention is not limited to the embodiments described in these examples.

Coil components were manufactured as specified below:

Rectangular planar part: Long side L of 2.52 mm, short side S of 2.0 mm, thickness T of 0.275 mm Pillar part (dimensions including the coil and outer sheath): 1.25 to 1.81 mm in the long-side L direction, 0.67 to 0.77 mm in the short-side S direction, 0.4 mm in the long-axis direction Winding: Copper wire coated with polyimide resin, Ø0.12 mm Number of windings: 8.5 turns Terminal electrodes: Ag paste (sintered)+Ag paste (cured)+Ni/Sn plating Resin for outer sheath: Epoxy resin The material and manufacturing method of each core (pillar part 31, rectangular planar parts 32, 33) are specified below.

In Examples 1 and 2 and Comparative Example 1, Ni—Zn ferrite material was compression-molded and then sintered in atmosphere at 1000° C. to obtain the core (magnetic permeability: 400).

In Example 3, Mn—Zn ferrite material was compression-molded and then sintered in nitrogen ambience at 1180° C. to obtain the core (magnetic permeability: 2000).

In Example 4, metal magnetic grains constituted by 92 percent by weight of Fe, 3 percent by weight of Si and 5 percent by weight of Cr were compression-molded and then sintered in atmosphere at 700° C. to obtain the core (magnetic permeability: 30).

The fill ratio and cross-section area of each pillar part 31 are shown in Table 1 below.

TABLE 1

| | Fill ratio | Cross-section area |
|---|---|---|
| Comparative Example 1 | 98% | 0.96 $mm^2$ |
| Example 1 | 98% | 1.09 $mm^2$ |
| Example 2 | 98% | 1.11 $mm^2$ |
| Example 3 | 97% | 1.29 $mm^2$ |
| Example 4 | 92% | 1.29 $mm^2$ |

The magnetic grains contained in each outer sheath 11 are shown below.

In Example 1 and Comparative Example 1, sintered Ni—Zn ferrite powder was used.

In Examples 2 to 4, material obtained by mixing the aforementioned FeSiCr grains and Fe grains (purity: 99.6%) at a ratio of 1:1 was used.

In all Examples and Comparative Example 1, magnetic grains were mixed with epoxy resin to each specific fill ratio as shown below, after which the mixture was taken up with a metal roller and transferred onto the coil 21 to form the outer sheath 11.

The fill ratio, thicknesses $P_L$, $P_S$, and cross-section area of each outer sheath 11 are shown in Table 2 below.

TABLE 2

| | Fill ratio | Thickness $P_L$ | Thickness $P_S$ | Cross-section area |
|---|---|---|---|---|
| Comparative Example 1 | 70% | 0.29 mm | 0.28 mm | 1.94 $mm^2$ |
| Example 1 | 75% | 0.15 mm | 0.32 mm | 1.71 $mm^2$ |
| Example 2 | 75% | 0.09 mm | 0.35 mm | 1.65 $mm^2$ |
| Example 3 | 85% | 0 mm | 0.31 mm | 1.23 $mm^2$ |
| Example 4 | 88% | 0 mm | 0.30 mm | 1.23 $mm^2$ |

The fill ratios above were each obtained by observing a section of a sample using a scanning electron microscope (SEM) and then obtaining the percent ratio accounted for by the ferrite material or metal magnetic grains. Also, the cross-section areas were each obtained from a SEM image capturing the pillar part 31 and outer sheath 11 in a section cut across the center of the pillar part and in parallel with the principle faces.

(Evaluation)

For each sample, inductance at 1 MHz was measured using a LCR meter.

In addition, direct current was applied to each sample to lower the inductance, and when the inductance dropped to 0.7 μH, the corresponding current was evaluated as saturated current.

The values of inductance and saturated current are shown in Table 3 below.

TABLE 3

| | Inductance [μH] | Saturated current [A] |
|---|---|---|
| Comparative Example 1 | 1.01 | 2.01 |
| Example 1 | 1.10 | 2.22 |
| Example 2 | 1.08 | 2.81 |
| Example 3 | 1.07 | 3.45 |
| Example 4 | 0.95 | 4.02 |

It should be noted that, in the Examples, the terminal electrodes on the ST plane along the short side of the rectangular planar part were not found spotted by the material of the outer sheath 11.

The present invention includes the above mentioned embodiments and other various embodiments including the following: The pillar part has a rectangular cross section which is substantially homologous to or different from the cross section of the rectangular planar part, and which may be edge-rounded; $P_S$ is the highest thickness along the short side of the outer sheath as viewed from above, and is the lowest thickness along the vertical pillar part surface on the short side of the outer sheath as viewed from side; the shape of a cross section of the outer sheath is a quadrangle which is edge-rounded to the degree where the shape is between a quadrangle and an ellipse; the outer sheath is formed only on one side, two sides, or three sides or all the sides entirely of the pillar part; and the long side of the rectangular planar part is about 10% to about 40% longer than its short side.

In the present disclosure where conditions and/or structures are not specified, a skilled artisan in the art can readily provide such conditions and/or structures, in view of the present disclosure, as a matter of routine experimentation. Also, in the present disclosure including the examples described above, any ranges applied in some embodiments may include or exclude the lower and/or upper endpoints, and any values of variables indicated may refer to precise values or approximate values and include equivalents, and may refer to average, median, representative, majority, etc. in some embodiments. Further, in this disclosure, "a" may refer to a species or a genus including multiple species, and "the invention" or "the present invention" may refer to at least one of the embodiments or aspects explicitly, necessarily, or inherently disclosed herein. The terms "constituted by" and "having" refer independently to "typically or broadly comprising", "comprising", "consisting essentially of", or "consisting of" in some embodiments. In this disclosure, any defined meanings do not necessarily exclude ordinary and customary meanings in some embodiments.

It will be understood by those of skill in the art that numerous and various modifications can be made without departing from the spirit of the present invention. Therefore, it should be clearly understood that the forms of the present invention are illustrative only and are not intended to limit the scope of the present invention.

We claim:

1. A coil component comprising:

a pillar part;

first and second rectangular planar parts, each having rectangular principle faces with long sides and short sides as well as side faces extending in a thickness direction;

a coil formed by winding an insulating sheath conductor around the pillar part;

two terminal electrodes electrically connected to both ends of the coil; and an outer sheath containing magnetic grains and resin material and covering the coil at least partially;

wherein both ends of the pillar part are attached to the principle faces of the first and second rectangular planar parts, respectively;

the pillar part and first and second rectangular planar parts are each made of a magnetic body;

the two terminal electrodes are respectively formed along two planes specified by the short sides of the outer principle face and side faces extending in a thickness direction, of the first rectangular planar part;

a thickness $P_L$ in the long-side direction and a thickness $P_S$ in the short-side direction, of the outer sheath, in a cross section cut across a center of the pillar part and in parallel with the principle faces, satisfy a relationship of $P_L<P_S$; and the outer sheath is concaved around an outer periphery of the outer sheath between the first and second rectangular planar parts as viewed in a direction perpendicular to the thickness direction.

2. A coil component according to claim 1, wherein the magnetic grains contained in the outer sheath are metal magnetic grains.

3. A coil component according to claim 1, wherein a cross-section area of the pillar part in a section cut across the center of the pillar part and in parallel with the principle faces, is greater than a cross-section area of the outer sheath.

4. A coil component according to claim 2, wherein a cross-section area of the pillar part in a section cut across the center of the pillar part and in parallel with the principle faces, is greater than a cross-section area of the outer sheath.

5. A coil component according to claim 1, wherein both ends of the coil are each led out to one plane specified by a long side and side face extending in the thickness direction, of the first rectangular planar part, and led-out parts are covered with the outer sheath.

6. A coil component according to claim 2, wherein both ends of the coil are each led out to one plane specified by a long side and side face extending in the thickness direction, of the first rectangular planar part, and led-out parts are covered with the outer sheath.

7. A coil component according to claim 3, wherein both ends of the coil are each led out to one plane specified by a long side and side face extending in the thickness direction, of the first rectangular planar part, and led-out parts are covered with the outer sheath.

8. A coil component according to claim 1, wherein both ends of the coil are each joined to one plane specified by a long side and side face extending in the thickness direction, of the first rectangular planar part, and joined parts are covered with the outer sheath.

9. A coil component according to claim 2, wherein both ends of the coil are each joined to one plane specified by a long side and side face extending in the thickness direction, of the first rectangular planar part, and joined parts are covered with the outer sheath.

10. A coil component according to claim 3, wherein both ends of the coil are each joined to one plane specified by a long side and side face extending in the thickness direction, of the first rectangular planar part, and joined parts are covered with the outer sheath.

11. An electronic device equipped with a coil component according to claim 1.

12. An electronic device equipped with a coil component according to claim 2.

13. An electronic device equipped with a coil component according to claim 3.

14. An electronic device equipped with a coil component according to claim 4.

15. An electronic device equipped with a coil component according to claim 5.

16. An electronic device equipped with a coil component according to claim 6.

17. An electronic device equipped with a coil component according to claim 7.

18. An electronic device equipped with a coil component according to claim 8.

19. An electronic device equipped with a coil component according to claim 9.

20. An electronic device equipped with a coil component according to claim 10.

* * * * *